US007252480B2

(12) United States Patent
Langley et al.

(10) Patent No.: US 7,252,480 B2
(45) Date of Patent: Aug. 7, 2007

(54) METHODS FOR GENERATION OF DUAL THICKNESS INTERNAL PACK COATINGS AND OBJECTS PRODUCED THEREBY

(75) Inventors: Nigel Brian Thomas Langley, Danvers, MA (US); Janet Elizabeth Gaewsky, Reading, MA (US); Matthew Taylor Lewis, Malden, MA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/016,109

(22) Filed: Dec. 17, 2004

(65) Prior Publication Data

US 2007/0128027 A1 Jun. 7, 2007

(51) Int. Cl.
*F01D 5/14* (2006.01)
*F01D 5/18* (2006.01)

(52) U.S. Cl. ..... 416/232; 416/241 R

(58) Field of Classification Search ..... 416/97 R, 416/232, 239, 241 R, 230, 189, 197, 210, 416/202; 427/230, 239, 189, 197, 201, 202
See application file for complete search history.

(56) References Cited

U.S. PATENT DOCUMENTS

| | | | | |
|---|---|---|---|---|
| 3,867,184 | A | 2/1975 | Baldi et al. | |
| 3,900,613 | A | 8/1975 | Galmiche et al. | |
| 3,936,539 | A | 2/1976 | Baldi et al. | |
| 4,332,843 | A | 6/1982 | Ahuja et al. | |
| 5,215,785 | A | 6/1993 | Strasser et al. | |
| 5,334,417 | A | 8/1994 | Rafferty et al. | |
| 5,441,767 | A | 8/1995 | DeSaulniers | |
| 5,867,762 | A | 2/1999 | Rafferty et al. | |
| 5,928,725 | A * | 7/1999 | Howard et al. | 427/237 |
| 6,435,830 | B1 * | 8/2002 | Allen et al. | 416/193 A |
| 6,640,546 | B2 | 11/2003 | Lee et al. | |
| 6,652,914 | B1 | 11/2003 | Langley et al. | |
| 2003/0211242 | A1 | 11/2003 | Shah | |

FOREIGN PATENT DOCUMENTS

| | | |
|---|---|---|
| EP | 0 567 755 A1 | 11/1993 |
| EP | 0 654 542 A1 | 5/1995 |
| EP | 1 288 330 A1 | 3/2003 |
| EP | 05257709 | 4/2006 |
| WO | WO 94/26948 | 11/1994 |
| WO | WO 99/03599 | 1/1999 |

* cited by examiner

*Primary Examiner*—Edward K. Look
*Assistant Examiner*—Devin Hanan
(74) *Attorney, Agent, or Firm*—William Scott Andes; Armstrong Teasdale LLP

(57) ABSTRACT

A method for generating an internal pack coating having different, controlled thicknesses includes partially filling a root opening of a turbine blade having a cavity therein with a first powder and a second powder having different formulations so that the first powder contacts a first predefined portion of the surface of the cavity and the second powder contacts a second predefined portion of the surface of the cavity. The method further includes heating the object with the first powder and the second powder therein to thereby produce a coating of the internal cavity having different coating thicknesses over the first portion of the surface of the cavity and the second portion of the surface of the cavity.

21 Claims, 4 Drawing Sheets

METHODS FOR GENERATION OF DUAL THICKNESS INTERNAL PACK COATINGS AND OBJECTS PRODUCED THEREBY

BACKGROUND OF THE INVENTION

This invention relates generally to methods for selectively coating internal passageways of an object with protective coatings having different thicknesses and to objects having such selectively coated internal passageways. The invention has particular use when the object being coated or which is so coated is a gas turbine blade, but the invention is not limited to gas turbine blades.

In an aircraft gas turbine (jet) engine, air is drawn into the front of the engine, compressed by a shaft-mounted compressor, and mixed with fuel. The mixture is burned, and the hot combustion gases are passed through a turbine mounted on the same shaft. The flow of combustion gas turns the turbine by impingement against an airfoil section of the turbine blades and vanes, which turns the shaft and provides power to the compressor. The hot exhaust gases flow from the back of the engine, driving it and the aircraft forward.

The hotter the combustion and exhaust gases, the more efficient is the operation of the jet engine. There is thus an incentive to raise the combustion and exhaust gas temperatures. The maximum temperature of the combustion gases is normally limited by the materials used to fabricate the hot-section components of the engine. These components include the turbine vanes and turbine blades of the gas turbine, upon which the hot combustion gases directly impinge. In current engines, the turbine vanes and blades are made of nickel-based superalloys, and can operate at temperatures of up to approximately 980–1150 degrees Celsius, or roughly 1800–2100 degrees Fahrenheit. These components are subject to damage by oxidation and corrosive agents.

Many approaches have been used to increase the operating temperature limits and service lives of the turbine blades and vanes to their current levels while achieving acceptable oxidation and corrosion resistance. The composition and processing of the base materials themselves have been improved. Cooling techniques are used, as for example by providing the component with internal cooling passages through which cooling air is flowed. However, as engine temperatures increase, the temperature of available cooling air also increases.

In at least one known configuration of gas turbine blade, a portion of the outer surfaces of the turbine blades is coated with a protective coating. One type of protective coating includes an aluminum-containing protective coating deposited upon the substrate material to be protected. The exposed surface of the aluminum-containing protective coating oxidizes to produce an aluminum oxide protective layer that protects the underlying surface.

Different portions of the outer surface of gas turbine blade require different types and thicknesses of protective coatings, and some portions require that there be no coating thereon. One known method for selective protection of the outer surfaces of a gas turbine blade is disclosed in U.S. Pat. No. 6,652,914 B1, issued Nov. 25, 2003 to Langley, et al. and assigned to General Electric Aviation Service Operation Pte. Ltd. In this method, a gas turbine blade that has previously been in service is protected by cleaning the gas turbine blade and then first depositing a precious metal layer over portions of the blade. The method includes a first deposition step in which a precious metal such as platinum is deposited on a surface of the blade, preferably by electrodeposition. The first layer is deposited on an airfoil first layer region of the airfoil. In the usual case, the first layer includes only portions of the surface of the airfoil, but not the trailing edge of the airfoil or the surface of the dovetail. The thickness of the first platinum layer is controlled to be about 0.002 mm to about 0.0032 mm, or about 0.00008 to about 0.000125 inches. In a second deposition step, a precious metal second layer is deposited overlying at least part of the platform portion of the second layer, but not overlying the airfoil portion of the first layer. The result is that the total thickness of the precious metal on the bottom side of the platform is greater than the total thickness on the airfoil.

A platinum alunimide protective coating is then formed by depositing an aluminum-containing layer overlying both the platform and the airfoil and interdiffusing the platinum and the aluminum. A vapor-phase aluminiding process is used in which baskets of chromium-aluminum alloy pellets are positioned within about 25 mm (one inch) of the gas turbine blade to be vapor-phase aluminided, in a retort. The retort containing the baskets and the turbine blade (or a plurality of blades together) are heated in an argon atmosphere at a heating rate of about 28 degrees Celsius (50 degrees Fahrenheit) per minute to a temperature of about 1080 degrees +/−14 degrees Celsius (1975 +/−25 degrees Fahrenheit), held at that temperature for about 3 hours +/−15 minutes, during which time aluminum is deposited, and then slow cooled to about 120 degrees Celsius (250 degrees Fahrenheit), and thence to room temperature. The times and temperatures may be varied to alter the thickness of the aluminum containing layer. The first, second, and third layers interdiffuse to form an interdiffused airfoil platinum aluminide protective coating over the airfoil first layer region, and a platform interdiffused platinum aluminide protective layer over the platform first layer region. A further heating can be applied to further interdiffuse the layers, and the layers cleaned. The resulting platform interdiffused protective layer has a different thickness than the airfoil interdiffused protective layer, largely as a result of differences in the thicknesses of the separately applied precious metal layers.

As noted above, however, modern gas turbine blades are cooled by passing cooling air through internal cooling passages. As engine temperatures increase, the temperature of available cooling air also increases, and corrosion can occur in these internal passages as well as on the external surfaces.

Internal coating thickness requirements for turbine blades vary depending upon location. For example, a thin coating is required in high stress areas such as the blade shank, and a robust, thick coating is required in other areas such as airfoil cavities to protect against the environment. If only a single thickness can be accomplished, the areas that require a thicker coating may experience a reduction in environmental life, or areas that require a thinner coating may experience a reduction in mechanical life. At least one type of turbine blade with a thin aluminum coating in the airfoil is known to have experienced airfoil internal oxidation. However, due to high shank stresses and technical challenges relating to the size of the blade, the internal coating is targeted to meet the shank requirement (less than 0.0254 mm or 0.001 inch coating thickness) and is the same throughout the internal cavities.

There is at least one known pack coating process, described in patent application Publication No. U.S. 2003/0211242, published Nov. 13, 2003, that coats an entire internal passage with a single coating thickness. However, small blades or other objects cannot be plumbed with vapor phase coating (VPC) to target a different coating thickness to different locations using this process.

BRIEF DESCRIPTION OF THE INVENTION

Some configurations of the present invention therefore provide a method for generating an internal pack coating having different, controlled thicknesses. The method includes partially filling a cavity of an object to be coated with a first powder having a first formulation so that the first powder settles into the cavity and contacts a first preselected portion of a surface of the cavity and leaves a remaining space within the cavity. The method further includes filling at least a portion of the remaining space within the cavity with a second powder having a second formulation different from the first formulation, so that the first portion of the surface of the cavity is in contact with the first powder and a second, different preselected portion of the surface of the cavity is in contact with the second powder. The object is then heated with the first powder and the second powder therein to thereby produce a coating of the internal cavity having different coating thicknesses over the first portion of the surface of the cavity and the second portion of the surface of the cavity.

In some configurations of the present invention, a method is provided for generating an internal pack coating having different, controlled thicknesses. The method includes partially filling a root opening of a turbine blade having a cavity therein with a first powder and a second powder having different formulations so that the first powder contacts a first predefined portion of the surface of the cavity and the second powder contacts a second predefined portion of the surface of the cavity. The method further includes heating the object with the first powder and the second powder therein to thereby produce a coating of the internal cavity having different coating thicknesses over the first portion of the surface of the cavity and the second portion of the surface of the cavity.

Yet other configurations of the present invention provide a turbine blade having an internal cavity with predefined areas coated with selected, different coating thicknesses.

It will be seen that configurations of the present invention can meet internal coating thickness requirements for turbine blades that vary depending upon the internal surface location. Configurations of the present invention can, for example, produce a thin coating in high stress areas such as the blade shank, and a robust, thick coating in other areas such as airfoil cavities to protect against the environment.

DETAILED DESCRIPTION OF THE INVENTION

Figure 1:
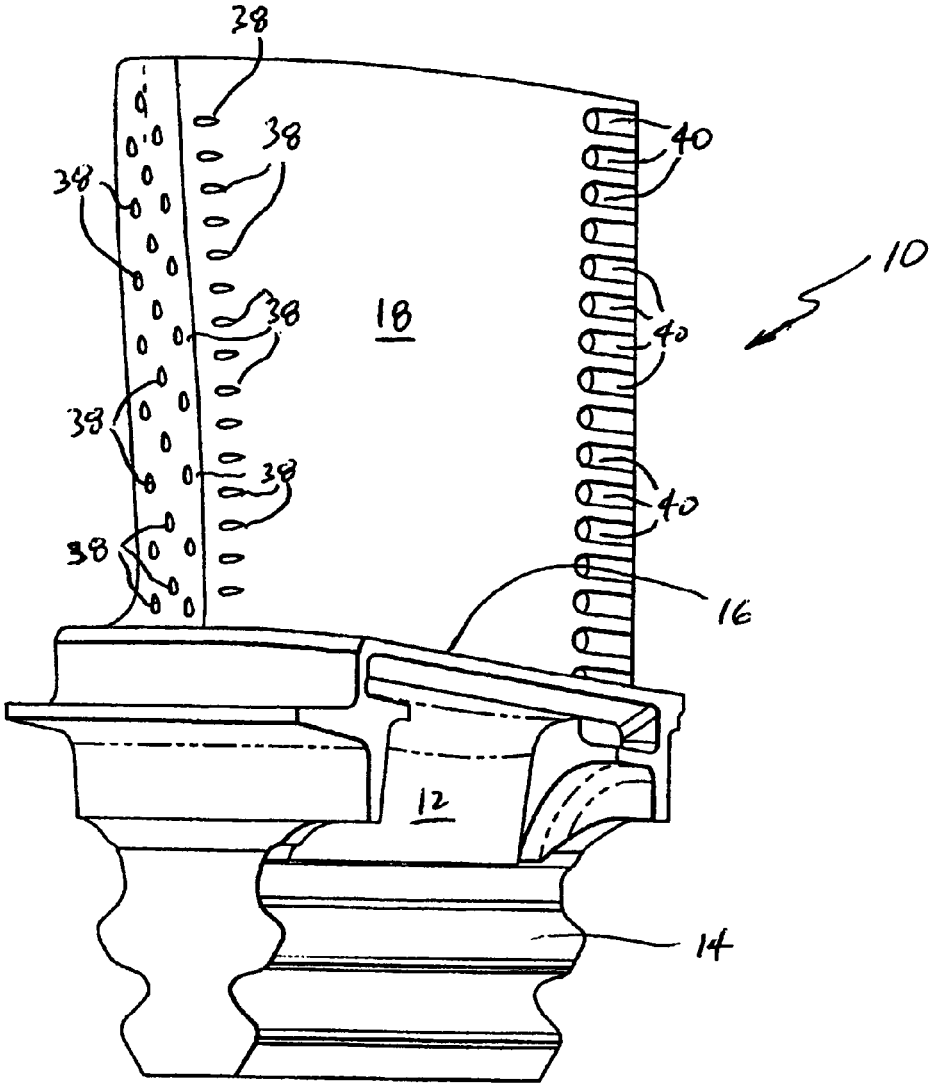
FIG. 1 is a perspective, diagrammatic view of a gas turbine engine blade from its concave side. The illustrated gas blade has internal passages that are not visible in this view.
Figure 2:
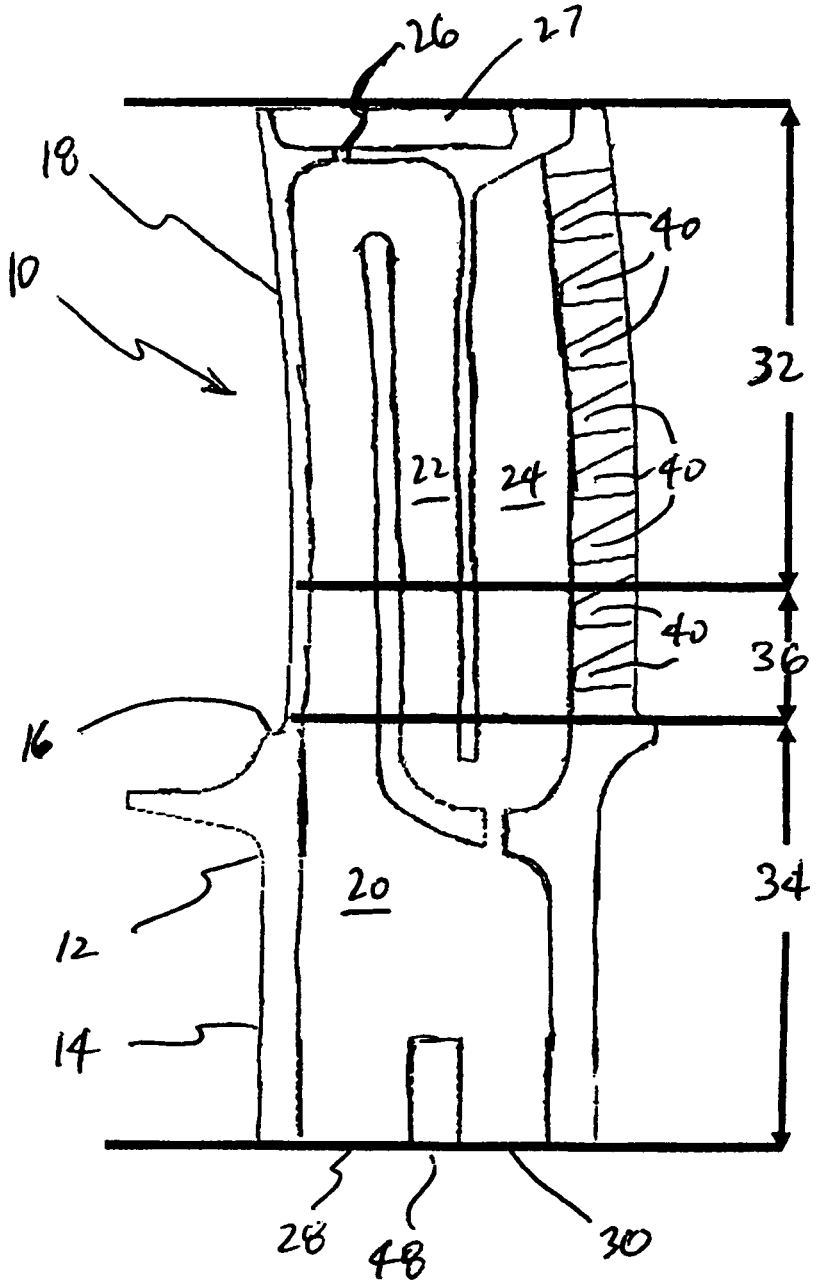
FIG. 2 is representation of a longitudinal cross-section of the gas turbine engine blade of FIG. 1.

In some configurations of the present invention and referring to FIG. 1, an object, such as a turbine blade 10, comprises a complex shape with one or more internal passages (not shown in FIG. 1). Generally, blade 10 comprises a base section 12, a dovetail section 14, a platform section 16, and an airfoil section 18. Dovetail section 14 and platform section 16 are considered herein as sections of base or shank section 12. Blade 10 also comprises one or more internal cavities that are not visible in the view of FIG. 1, but which are better seen in FIG. 2. Referring to FIG. 2, which shows a longitudinal cross-section through blade 10, one or more passageways 20, 22, and 24 comprise a root cooling passage or internal cavity of object or blade 10. In the illustrated configuration, passageways 20, 22, and 24 are interconnected and are open on at least one side of blade 10, for example, at the bottom of blade 10 by one or more external openings 28 and 30. There is also an additional recessed opening 26 in a recessed region 27 at the top of the blade 10 configuration shown in FIG. 1, but opening 26 may be temporarily waxed or otherwise sealed shut for reasons that will become evident below.

In some configurations of the present invention, surfaces of internal passageways 20, 22 and 24 are coated with a protective, dual thickness coating. By way of example and not of limitation, blade 10 is targeted to have a robust coating of approximately 0.056 mm (0.0022 inches) in a region 32 internal to airfoil section 18 and a thin coating of approximately 0.02 mm (0.0008 inches) in a region 34 internal to base region 12. Other thicknesses can be used. For example, in some configurations, the internal coating in region 32 of airfoil section 18 is approximately 0.046 mm (0.0018 inches). An internal transition region 36 between regions 32 and 34 is located in an internal section of airfoil section 32 above platform 16 in some configurations. These differential thickness coatings are controlled by pouring a controlled volume of a first aluminum-bearing coating powder into blade 10 and shaking blade 10 in a controlled manner to ensure that the powder uniformly fills the targeted part of the cavity, e.g., an internal cavity, passageway, or cavities and passageways in section 34. The size of the powder granules is also controlled to prevent clumping. (For example, particles passing through a relatively coarser sieve can be filtered by a relatively finer sieve, and particles passed through the relatively coarser sieve but retained by the relatively finer sieve are used as the controlled-size powder granules. By preventing very fine particles from being used, clumps of very fine aluminum powder can be prevented from clumping together during a subsequent heating step. The best sizes of the sieves can be determined empirically.) Next, an aluminum-bearing coating powder having a different aluminum strength is poured into the blade and layered on top of the first-poured aluminum-bearing coating powder, and the blade is heated to generate aluminum coatings of different controlled thicknesses corresponding to the different aluminum strengths. In tests performed in which blade 10 was a General Electric CF34-3 stage 1, one configuration of the method of the present invention produced an internal shank or base coating in region 34 having an average thickness of 0.023 mm or 0.0009 inches. The process also produced an internal airfoil coating in region 32 having an average thickness of 0.04572 mm or 0.0018 inches. A transition zone 36 was located in airfoil 18 above platform 16 and below 20% span.

In some configurations of the present invention, internal and external coatings are applied simultaneously. For example, the coating process starts by applying platinum to some or all of the external surface of the blade, but this external coating is separate from and not part of the internal dual-thickness coating. In configurations in which platinum is applied externally, the process that generates the internal dual-thickness internal coating follows the application of the external platinum coating.

In some configurations of the present invention and referring to FIGS. 1 and 2, cooling holes 26, 38 and trailing edge cooling slots 40 in the airfoil are waxed. More particularly, small droplets of wax are used to seal each opening 38, 40 individually, leaving only external openings 28, and 30 open. By sealing the cooling holes and trailing edge cooling slots, the coating powder used can be poured into external openings 28 and 30 to fill the one or more internal cavities of object 10 without leakage out the sealed holes and slots.

Figure 3:
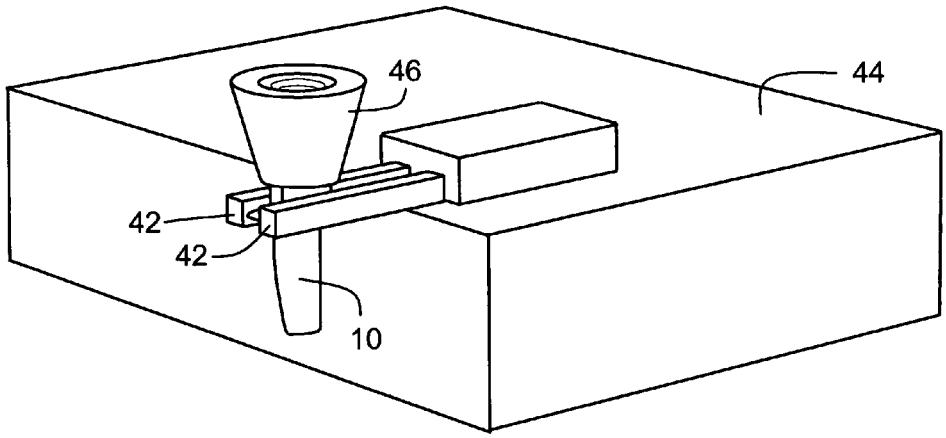
FIG. 3 is a perspective view of the gas turbine engine blade of FIG. 1 held in a fixture on a vibrating table in a boot, ready to be filled with coating powder.

In some configurations and referring to FIGS. 1, 2, and 3, waxed blades 10 are set in a fixture 42 on a vibrating table 44 and affixed with a boot 46, for example, a neoprene boot. Blade 10 is held upside down in fixture 42 so that boot 46, which fits snugly to blade dovetail 14, can act as a funnel directing the coating powder into the one or more root openings 28 and 30 of blade 10. As table 44 vibrates, a measured amount of a first powder formulation is poured into blade 10. The measured amount is sufficient to at least fill region 32 of blade 10 (which is upside down in its fixture 42) and perhaps part or all of region 36, but no part of region 34 with the first powder formulation. In some configurations, the first powder formulation comprises 33% 0.002 inch (0.0508 mm) mesh Cr+Al and 67% 0.0018 inch (0.04572 mm) mesh $Al_2O_3$. This formulation is used for both the first layer internal coating as well as the external coating in some configurations. Care is taken to ensure that all of the first powder goes into the one or more internal cavities or passageways 20, 22, and 24 in region 32 in blade 10 and that none is lost in the filling of blade 10. This care is taken because the volume of the first powder fills the cavities to a certain depth and determines the target region that is coated to the first thickness. Table 44 vibrates to ensure that the first coating powder settles evenly within blade 10 to the intended depth and accelerates the flow rate of the first coating powder into the blade. Any other processes that result in the coating powder settling evenly to the intended depth can be used in place of or in addition to table vibration.

Once the allotted amount of coating powder has settled into the one or more internal cavities 20, 22, and 24 in region 32, the next layer of coating powder is added. The formulation of this second powder is 7% 0.002 inch (0.0508 mm) Cr+Al and 93% 0.0018 inch (0.04572 mm) mesh $Al_2O_3$ in some configurations. This second powder formulation is poured into blade 10 in manner similar to that in which the first powder formulation was poured therein, and is layered on top of the first powder formulation. If only two thicknesses of coating are needed inside the blade and an adequate amount of the second powder formulation is available, the second powder formulation can simply be poured into the blade until the blade is filled without premeasuring the amount of the second powder formulation. In some configurations, vibrating table 44 runs continuously during the filling process for both strengths of coating powder. The formulations of the first and second powders in some configurations is between about 5% and 40% metallic aluminum-containing powder, preferably Cr+Al, with the remainder a ceramic powder, such as $Al_2O_3$. The minimum particle size of the powder in some configurations is about 0.0015 inch (0.0381 mm), and the maximum is not greater than about 0.005 inch (0.127 mm). Suitable particle formulations for coating powders can be found in patent application Publication No. U.S. 2003/0211242, published Nov. 13, 2003, particularly at paragraphs [0011]–[0013].

In some configurations, a premeasured amount of the second powder formulation is added, and a third or even more additional powder formulations are then poured in to generate three or more internal coating thicknesses (possibly with additional transition zones). However, the generalization to additional layers will be evident upon an understanding of the present example configuration, which utilizes only two powder strengths.

After the second strength of coating powder (i.e., the second formulation) has been added and the blade 10 cavity or cavities 20, 22, and 24 are full, vibrating table 44 is stopped (in configurations in which table 44 is still vibrating) and boot 46 is removed. An annealed nickel tape (not shown in the drawings) is used to seal the root opening or openings 28 and 30 of blade 10 in some configurations, although any suitable alternative sealing method can be used. Blade 10 root end 48 is kept upright and/or other steps are taken to avoid mixing of the two strengths of coating powder and to avoid spilling of the coating powder. In some configurations of the present invention, any necessary exterior areas of blade 10 are masked to prevent contact with an external coating powder. After this masking (if needed), blade 10 in some configurations is inserted into a tray (not shown in the Figures) filled with a coating powder used to coat the external surfaces of blade 10. In other configurations, blade 10 is heated without an external coating powder in contact with its external surfaces. Whether an external coating is applied or not, blade 10 is heated with different strengths of internal powders in contact with separate regions 32, 34 of internal surfaces of the one or more internal cavities 20, 22, and 24. This heating results in a differential thickness of internal coating in these regions because of the different powder strengths. The heating in some configurations is to between about 1750° F. and about 2000° F. (about 955° C. and about 1095° C.) for a time between about 2 hours and about 12 hours.

Figure 4:
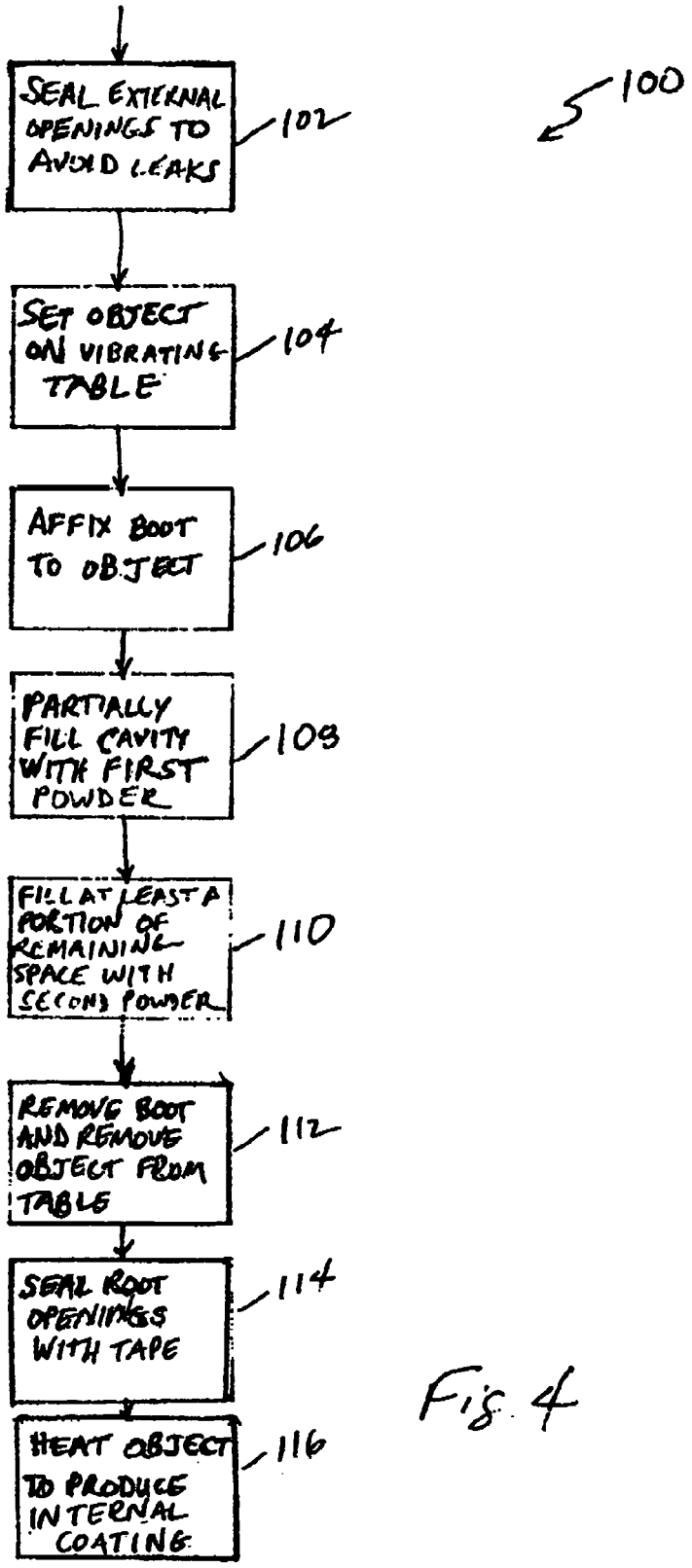
FIG. 4 is a flow chart representative of some configurations of the present invention.

Referring to flow chart 100 of FIG. 4 as well as FIGS. 1, 2, and 3, some configurations of the present invention partially fill 108 a cavity 20, 22, 24 of an object 10 to be coated with a first powder having a first formulation so that the first powder settles into the cavity and contacts a first preselected portion 32 of a surface of the cavity and leaves a remaining space (denoted by region 34) within the cavity.

At least a portion 34 of the remaining space within the cavity is then filled 110 with a second powder having a second formulation different from the first formulation, so that the first portion 32 of the surface of the cavity is in contact with the first powder and a second, different preselected portion 34 of the cavity is in contact with the second powder.

Object 10 is then heated 116 to thereby produce a coating of the internal cavity having different coating thickness over the first portion 32 of the surface of the cavity and the second portion 34 of the surface of the cavity. The powder is removed from the coated cavity after heating.

The first powder and the second powder comprise different strengths of aluminum in some configurations of the present invention. For example, in some configurations, either the first powder or the second powder has a composition of 33% 200 mesh Cr+Al and 67% 180 mesh $Al_2O_3$, and the other powder has a composition of 7% 200 mesh Cr+Al and 93% 180 mesh $Al_2O_3$. In some configurations, object 10 is a turbine blade and the cavity in the turbine blade includes a root cooling passage 20, 22, 24 and one or more external openings that may include cooling holes 38, trailing edge cooling slots 40, and combinations thereof. In such configurations, the method can further include sealing 102 the one or more external openings with wax so that the first powder and the second powder do not leak out during filling. (At least one opening is left open to allow the filling to occur. For example, openings 28 and 30 in base 12 root end 48, are left open.)

In some configurations, object 10 is set 104 into a fixture 42 on a vibrating table 44 to vibrate the object while the object is being filled with the first powder and with the second powder. Also, in some configurations, a boot 46 (such as a neoprene boot) is affixed 106 to the object, and the filling steps 108 and 110 either include or consist of pouring the first powder and the second powder, respectively, into the cavity of the object using the boot as a funnel. In configurations in which object 10 is a turbine blade, boot 46 fits snugly to a dovetail 14 of the blade. In configurations in which a fixture and/or a boot are used, the object is removed therefrom 112 prior to heating at 116.

Some configurations of the invention include sealing 114 root opening 28, 30 with a tape, such as an annealed nickel tape, prior to heating at 116.

Some configurations of the present invention define more than two internal zones of an object 10. For example, one configuration fills object 10 with at least a third powder having a formulation different from at least one of the first powder and the second powder. (In particular, the compositions of the powders are different in adjacent poured layers.) In this manner, a third portion of the surface of the cavity is in contact with the third powder. Heating the object with the first powder and the second powder includes heating the object with the first powder, the second powder, and the third powder therein to thereby produce a coating of the internal cavity having three coating thicknesses over the first portion of the surface of the cavity, the second portion of the surface of the cavity, and the third portion of the surface of the cavity. At least two of the three coating thicknesses are different from one another, i.e., adjacent layers have different thicknesses.

Some configurations of the present invention provide a turbine blade 10 having an internal cavity 20, 22, 24 with predefined surface areas 34, 36 coated with selected different metal thicknesses. The metal coatings comprise aluminum in some configurations. Turbine blade 10 in some configurations comprises a shank or base region 12 and an airfoil region 18, and the cavity in the airfoil region is coated with a selected metal thickness different from that of the cavity in the shank or base region. Some configurations provide a transition zone 36 between the regions with the different coating thicknesses. In various configurations, this transition region is above platform 16 and below 20% span.

It will thus be appreciated that configurations of the present invention can meet internal coating thickness requirements for turbine blades that vary depending upon the internal surface location. Configurations of the present invention can, for example, produce a thin coating in high stress areas such as the blade shank, and a robust, thick coating in other areas such as airfoil cavities to protect against the environment.

While the invention has been described in terms of various specific embodiments, those skilled in the art will recognize that the invention can be practiced with modification within the spirit and scope of the claims. Also, claims reciting a single instance or a specific number of instances of an element, step, structure, void, etc., are intended to include within their scope configurations in which more than the number of instances of the recited element, step, structure, void, etc., are present or used, unless such configurations are explicitly excluded.

What is claimed is:

1. A method for generating an internal pack coating having different, controlled thicknesses, said method comprising:

partially filling a cavity of an object to be coated with a first powder having a first formulation so that the first powder settles into the cavity and contacts a first preselected portion of a surface of the cavity and leaves a remaining space within the cavity;

filling at least a portion of the remaining space within the cavity with a second powder having a second formulation different from the first formulation, so that the first portion of the surface of the cavity is in contact with the first powder and a second, different preselected portion of the surface of the cavity is in contact with the second powder; and heating the object with the first powder and the second powder therein to thereby produce a coating of the internal cavity having different coating thicknesses over the first portion of the surface of the cavity and the second portion of the surface of the cavity.

2. A method in accordance with claim 1 wherein the first powder comprises aluminum and the second powder also comprises aluminum, but at a different strength than the first powder.

3. A method in accordance with claim 1 wherein either the first powder or the second powder has a composition of between about 5% and 40% metallic aluminum-containing powder, with the remainder a ceramic powder, and said powder has a minimum particle size of about 0.0381 mm, and a maximum particle size not greater than about 0.127 mm.

4. A method in accordance with claim 1 wherein the object is a turbine blade, and the cavity in the blade includes a root cooling passage and one or more external openings selected from the group consisting of cooling holes, trailing edge cooling slots, and combinations thereof, and said method further comprises sealing the one or more external openings with wax so that the first powder and the second powder do not leak out during filling.

5. A method in accordance with claim 1 further comprising setting the object in a fixture on a vibrating table to vibrate the object while the object is being filled with the first powder and with the second powder.

6. A method in accordance with claim 5 further comprising affixing a boot to the object and said filling the object with the first powder and said filling the object with the second powder comprise funneling the first powder and the second powder, respectively, into the cavity of the object using the boot.

7. A method in accordance with claim 6 wherein the object is a turbine blade, and said affixing the boot to the object comprises fitting the boot snugly to a dovetail of the blade.

8. A method in accordance with claim 5 wherein the object is a turbine blade, and wherein said partially filling a cavity of an object further comprises pouring the first powder into a root opening of the blade, said filling at least a portion of the remaining space within the cavity further comprises pouring the second powder into a root opening of the blade, and further comprising sealing the root opening with tape after said pouring the first powder and said pouring the second powder.

9. A method in accordance with claim 8 wherein said sealing the root opening with tape further comprises sealing the root opening with an annealed nickel tape.

10. A method in accordance with claim 1 further comprising filling the object with at least a third powder having a formulation different from at least one of the first powder and the second powder, so that a third, different portion of the surface of the cavity is in contact with the third powder, and said heating the object with the first powder and the second powder therein further comprises heating the object with the first powder, the second powder, and the third powder therein to thereby produce a coating of the internal cavity having three coating thicknesses over the first portion of the surface of the cavity, the second portion of the surface of the cavity, and the third portion of the surface of the cavity, wherein at least two of the three coating thicknesses are different from one another.

11. A method for generating an internal pack coating having different, controlled thicknesses, said method comprising:

partially filling a root opening of a turbine blade having a cavity therein with a first powder and a second powder having different formulations so that the first powder contacts a first predefined portion of the surface of the cavity and the second powder contacts a second predefined portion of the surface of the cavity; and heating the object with the first powder and the second powder therein to thereby produce a coating of the internal cavity having different coating thicknesses over the first portion of the surface of the cavity and the second portion of the surface of the cavity.

12. A method in accordance with claim 11 wherein the turbine blade has an airfoil section and a shank or base section, and wherein the first predefined portion of the surface of the cavity is in the airfoil section and the second predefined portion of the surface of the cavity is in the shank or base section, or vice-versa.

13. A method in accordance with claim 12 further comprising providing a transition zone in the coating between said airfoil and said shank in the airfoil above a platform and below 20% span.

14. A method in accordance with claim 11 further comprising controlling granule size of the powder to prevent clumping.

15. A turbine blade produced by the method of claim 11.

16. A turbine blade produced by the method of claim 12.

17. A turbine blade produced by the method of claim 13.

18. A turbine blade comprising an internal cavity having predefined surface areas, wherein one surface area is coated with a first coating comprising a first formulation and a different surface area is coated with a second coating comprising a second formulation.

19. A turbine blade in accordance with claim 18 wherein said first and second coatings comprise different thicknesses.

20. A turbine blade in accordance with claim 18 wherein said predefined surface areas comprise a shank region and an airfoil region, and said airfoil region is coated with a selected metal thickness different from that of said shank region.

21. A turbine blade in accordance with claim 20 wherein said predefined surface areas further comprise a transition zone between said airfoil region and said shank region above a platform and below 20% span.

* * * * *